US011118586B2

(12) United States Patent
Chang et al.

(10) Patent No.: US 11,118,586 B2
(45) Date of Patent: Sep. 14, 2021

(54) BAILER-TYPE LONG-SHAFT PUMP AND APPLICATION THEREOF

(71) Applicant: JIANGSU TAIHU PLANNING AND DESIGN INSTITUTE OF WATER RESOURCES CO., LTD., Suzhou (CN)

(72) Inventors: Yufeng Chang, Suzhou (CN); Ye Chen, Suzhou (CN); Xiaofeng Gu, Suzhou (CN); Hao Chen, Suzhou (CN); Jianzhong Yu, Suzhou (CN); Yibing Guan, Suzhou (CN); Fei Wang, Suzhou (CN); Ben Lv, Suzhou2 (CN); Fang Wu, Suzhou (CN); Shi Cheng, Suzhou (CN)

(73) Assignee: JIANGSU TAIHU PLANNING AND DESIGN INSTITUTE OF WATER RESOURCES CO., LTD., Suzhou (CN)

( * ) Notice: Subject to any disclaimer, the term of this patent is extended or adjusted under 35 U.S.C. 154(b) by 0 days.

(21) Appl. No.: 16/639,567

(22) PCT Filed: Mar. 13, 2018

(86) PCT No.: PCT/CN2018/078794
§ 371 (c)(1),
(2) Date: Feb. 15, 2020

(87) PCT Pub. No.: WO2019/173960
PCT Pub. Date: Sep. 19, 2019

(65) Prior Publication Data

US 2020/0240416 A1 Jul. 30, 2020

(51) Int. Cl.
*F04D 13/02* (2006.01)
*F04D 13/06* (2006.01)
(Continued)

(52) U.S. Cl.
CPC ..... *F04D 13/021* (2013.01); *E03B 5/00* (2013.01); *E03F 7/10* (2013.01); *F04D 1/12* (2013.01);
(Continued)

(58) Field of Classification Search
CPC ..... F04D 1/12; F04D 29/185; F04D 29/225; F04D 13/021; F04D 13/06; F04D 13/12; E03F 7/10; F03B 7/00; E03B 5/00
See application file for complete search history.

(56) References Cited

U.S. PATENT DOCUMENTS 3,740 A * 9/1844 Cook ..... F04D 29/225 416/179
44,240 A * 9/1864 Tyler ..... F04D 29/225 416/179
(Continued)

FOREIGN PATENT DOCUMENTS

EP 0593144 A2 * 4/1994 ..... B01D 21/0045
GB 2506899 A * 4/2014 ..... F03B 3/103

OTHER PUBLICATIONS

Wikipedia, "Scoop Wheel", 2016.*
Wikipedia, "Frequency Changer", 2017.*

*Primary Examiner* — Christopher S Bobish
(74) *Attorney, Agent, or Firm* — Zhihua Han; Wen IP LLC

(57) ABSTRACT

Disclosed are a bailer-type long-shaft pump (100) and an associated pump station (200). The long-shaft pump comprises a bailer vehicle (110), a long shaft (120), a bearing (130), a transmission device (140) and an electric motor (150). One end of the long shaft (120) successively passes through the bearing (130) and the transmission device (140) so as to be in transmission connection with a drive shaft of the electric motor (150). The pump station (200) comprises a pump station foundation (210), several equipment rooms
(Continued)

(231) transversely distributed at intervals and constructed on the pump station foundation (210), and two ends of the long shaft (120) are supported on side walls of two adjacent equipment rooms. The bailer-type long-shaft pump achieve large water flow and low lift, the pump station is space-saving, has shorter construction cycle, and reduces investment and operation costs.

9 Claims, 3 Drawing Sheets

(51) Int. Cl.

| | |
|---|---|
| ***F04D 29/22*** | (2006.01) |
| ***E03F 7/10*** | (2006.01) |
| ***E03B 5/00*** | (2006.01) |
| ***F04D 1/12*** | (2006.01) |
| ***F03B 7/00*** | (2006.01) |

(52) U.S. Cl.
CPC ..... *F04D 13/06* (2013.01); *F04D 29/225* (2013.01); *F03B 7/00* (2013.01)

(56) References Cited

U.S. PATENT DOCUMENTS

| | | | | | |
|---|---|---|---|---|---|
| 130,608 | A * | 8/1872 | Tyler | F03B 3/00 | 416/179 |
| 717,339 | A * | 12/1902 | Burrows | F04D 29/225 | 415/228 |
| 2,694,366 | A * | 11/1954 | James | F04B 19/14 | 198/702 |
| 2,964,191 | A * | 12/1960 | Arnold | E03F 7/10 | 210/241 |
| 5,735,665 | A * | 4/1998 | Kang | F03B 17/063 | 415/3.1 |
| 10,598,185 | B2 * | 3/2020 | Henny | F04D 13/043 | |
| 2014/0371028 | A1 * | 12/2014 | Billmeyer | F16H 1/46 | 475/337 |
| 2015/0275913 | A1 * | 10/2015 | Mohamed | F04D 29/225 | 416/179 |
| 2018/0142667 | A1 * | 5/2018 | Mallah | F03B 17/02 | |
| 2019/0360455 | A1 * | 11/2019 | Youssef | F03B 17/063 | |

* cited by examiner

BAILER-TYPE LONG-SHAFT PUMP AND APPLICATION THEREOF

CROSS REFERENCE TO RELATED APPLICATION

This application is a national stage application of International application number PCT/CN2018/078794, filed Mar. 13, 2018, titled "BAILER-TYPE LONG-SHAFT PUMP AND APPLICATION THEREOF," which is hereby incorporated by reference in its entirety.

TECHNICAL FIELD

The invention relates to the technical field of hydraulic engineering in general, and in particular to a bailer-type long-shaft pump and a pump station using the bailer-type long-shaft pump.

BACKGROUND

Pumping stations are common hydraulic constructions in hydraulic engineering and water conservancy projects. They are generally located at the junction of an inland river and an outer river in cities and towns; or on inland river dams in low-lying areas in rural areas. They are used to eliminate waterlogged water or to irrigate farmland. At present, horizontal pumps, such as vertical shaft cross-flow pumps and plane S-shaped shaft extension pumps, are the commonly used form of pumps in large-flow pumping stations. The pumping stations using the horizontal pumps have a low efficiency in general due to the relatively high ratio of the flow channel loss to the total head of the water pump, The pumping stations using the horizontal pumps also require dedicated main and auxiliary workshops and maintenance rooms. At the same time, the height of the pump room is also high, the construction period of the pump room is long, and the total investment of the pumping station is high.

SUMMARY

An objective of the present invention is to provide a large-flow, low-lift bailer-type long-shaft pump, which solves the problems of high cost and low efficiency of the large flow pumps used in the existing pumping stations, and brings along further advantages of simple structure, low cost, and easy installation.

The present invention further provides bailer-type long-shaft pumping station, which eliminates the requirement for main workshops, auxiliary workshops, and maintenance rooms. There will be no need for a pumping room above the ground, which reduces space requirement, shortens the construction period of the pumping station, and greatly reduces investment and operating costs for the pumping station.

In order to achieve the above results, the following technical solutions are adopted and disclosed as part of the present invention.

A bailer-type long-shaft pump, comprising: a plurality of bailer vehicles, a long shaft, a bearing, a transmission device, and an electric motor; wherein the transmission device comprises a planetary gearbox, an orthogonal shaft gearbox and a frequency converter, wherein one end of the long shaft successively passes through the bearing, the planetary gearbox, the orthogonal shaft gearbox and the frequency converter, so as to be in transmission connection with a drive shaft of the electric motor, wherein the bailer vehicle is provided with a cylindrical base configured to encase the long shaft and has at least three blades, wherein the blades are distributed on the surface of the cylindrical base in an annular array radially extending from the center of the long shaft; wherein adjacent blades and the surface of the cylindrical base enclose a space to form a bailing bucket capable of bailing water from a lower water level of a water channel to a higher water level of the water channel;

In some embodiments, each of the plurality of bailer vehicles (110) has equal numbers of blades.

In some embodiments, the blades from any two neighboring bailer vehicles are staggered and do not reside on the same plane.

A pump station using the bailer-type long-shaft pump, comprising: a pump station foundation that comprises a drainage section, a pumping section and a diversion section sequentially installed along the flow direction of the water channel, wherein the pumping section is provided with a plurality of equipment rooms distributed traversely across the water channel, wherein the equipment rooms are constructed on top of the pump station foundation and divide the pumping section into a plurality of pumping areas, wherein one end of the pumping area is a water supply end and another end of the pumping area is a water outlet end, wherein the water supply end and the water outlet end are divided with a partition, wherein at least one of the pumping areas is provided with the bailer-type long-shaft pump, wherein the long shaft of the bailer-type long-shaft pump and the bailer vehicle of the bailer-type long-shaft pump are located in the water supply end, wherein two ends of the long shaft are supported on the sidewalls between two adjacent equipment rooms, and wherein one end of the long shaft is connected to the electric motor through the transmission device in the equipment room.

In some embodiments, a recessed area is provided at part of the pump station foundation that is direct below the bailer vehicle, wherein the recessed area is arc-shaped and encompasses bottom of the bailer vehicle.

In some embodiments, the plurality of the equipment rooms are distributed at equal distance to each other.

In some embodiments, each of the pumping areas is provided with a bailer-type long-shaft pump, and the bailer-type long-shaft pumps are arrayed traversing the water channel either in a straight line or is parallel but staggered.

In some embodiments, a pedestrian bridge is provided that connects two adjacent equipment rooms.

In some embodiments, a sedimentation tank is provided near the water supply end and another sedimentation tank is provided near the water outlet end.

In some embodiments, wing walls are provided on both sides of the drainage section and the diversion section.

Compared with the prior art, the beneficial effects of the present invention are:

The bailer-type long-shaft pump of the invention has a simple structure, thus easy to manufacture. The bailer-type long-shaft pump has the benefits of large flow and low head, because water is pumped to the high water side of the river by the continuously rotating blades driven by the long shafts. By adjusting the number of bailer vehicles, the diameter and number of blades, the rotating speed of the pump, and the submergence depth of the blades according to the water channel width and water depths, a smooth and unobstructed short runner is achieved that results in effective improvement of the overall efficiency of the pump. When the head is large, the frequency converter (143) can be used to adjust the starting speed of the pump to reduce the starting torque of the pump and the output of the motor. After running of the pump stabilizes, the pump gradually returns to a predetermined speed.

In the pump station using the bailer-type long-shaft pump, a plurality of equipment rooms is distributed traversely across the water channel in the pumping section, producing a plurality of pumping areas. Within a pumping area, the bailer vehicles are installed onto the long shaft. One end of the long shaft is in transmission connection to the transmission device located inside of the equipment rooms. Thus, the pump station eliminates the requirements for main workshops, auxiliary workshops, maintenance rooms, and above-ground pumping rooms, which reduces the occupied space, shortens the construction period of the pumping station, and greatly reduces the investment and operating costs.

Still other embodiments of the present invention will become readily apparent to those skilled in the art from the following detailed description, wherein is described embodiments of the invention by way of illustrating the best mode contemplated for carrying out the invention. As will be realized, the invention is capable of other and different embodiments and its several details are capable of modifications in various obvious respects, all without departing from the spirit and the scope of the present invention. Accordingly, the drawings and detailed description are to be regarded as illustrative in nature and not as restrictive.

BRIEF DESCRIPTION OF THE DRAWINGS

The invention may best be understood by referring to the following description and accompanying drawings that are used to illustrate embodiments of the invention. The invention is illustrated by ways of example in the embodiments and it not limited in the figures of the accompanying drawings, in which like references indicates similar elements

The numbers and corresponding names in the figure are.

| | |
|---|---|
| 100. bailer-type long-shaft pump; | 110. plurality of bailer vehicles; |
| 111. blades; | 112. cylindrical base; |
| 120. long shaft; | 130. bearing; |
| 140. transmission device; | 141. planetary gearbox; |
| 142. orthogonal shaft gearbox; | 143. frequency converter; |
| 150. electric motor; | 200. pump station; |
| 210. pump station foundation; | 220. diversion section; |
| 221. sedimentation tank; | 230. pumping section; |
| 231. equipment room; | 232. pumping area; |
| 232a. water supply end; | 232b. water outlet end; |
| 233. pedestrian bridge; | 234. recessed area; |
| 240. drainage section; | 241. sedimentation tank. |

DETAILED DESCRIPTION OF THE PREFERRED EMBODIMENTS

Figure 1:
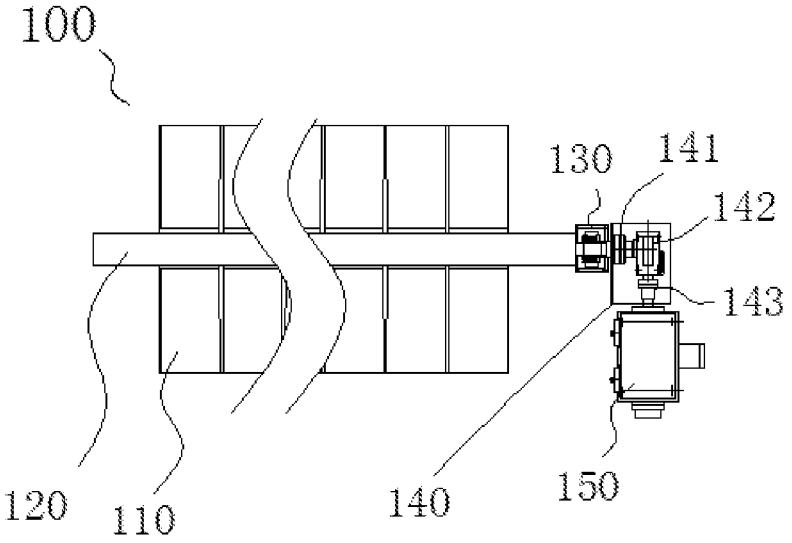
FIG. 1 is a schematic diagram showing the structure of a bailer-type long-shaft pump, in accordance to one embodiment.
Figure 2:
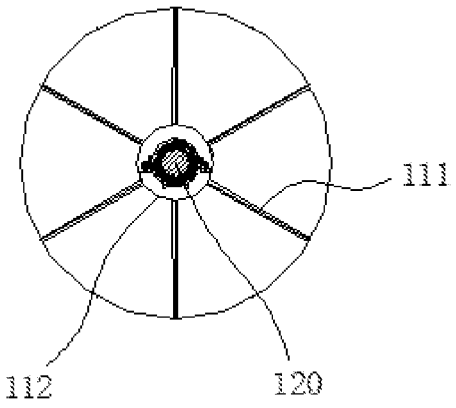
FIG. 2 is cross-sectional view of a bailer-type long-shaft pump, in accordance to one embodiment.
Figure 3:
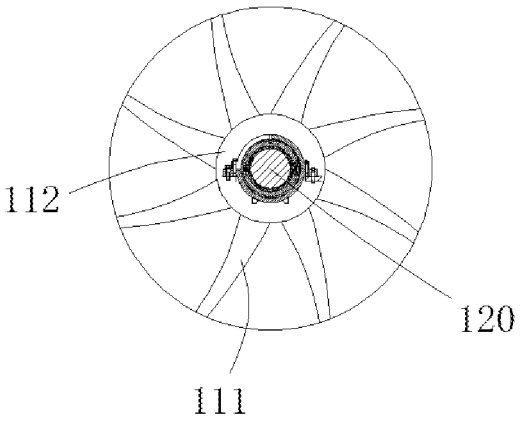
FIG. 3 is cross-sectional view of a bailer-type long-shaft pump, in accordance to one embodiment.
Figure 4:
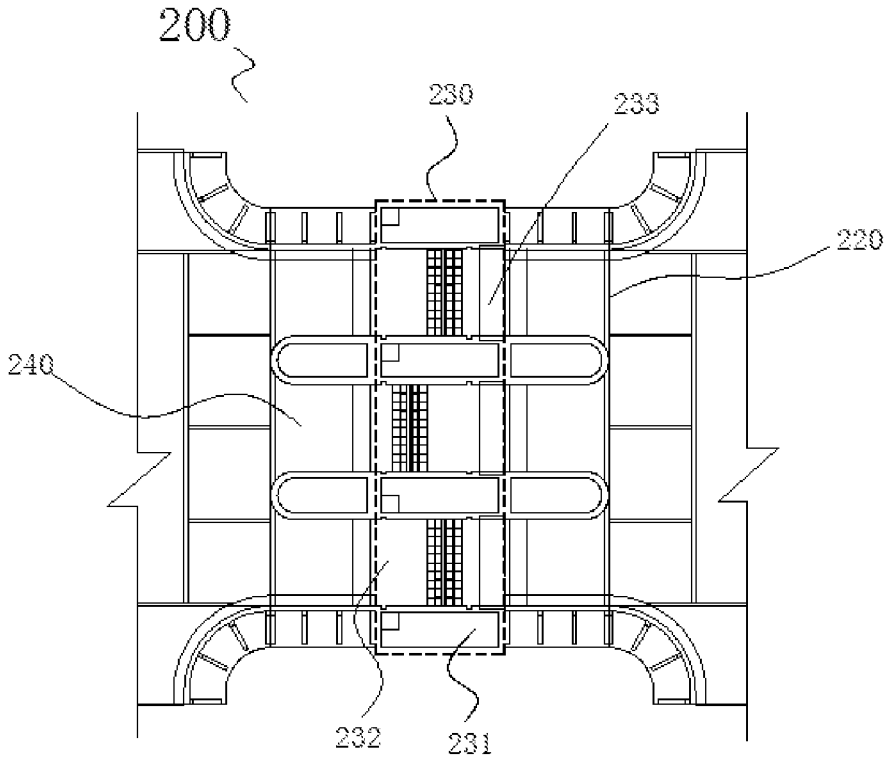
FIG. 4 is general plan view of a pump station using the bailer-type long-shaft pump, in accordance to one embodiment.
Figure 5:
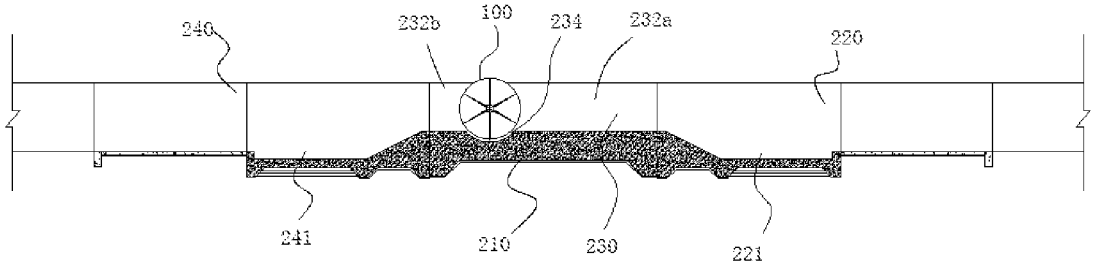
FIG. 5 is a longitudinal sectional view of a pump station using the bailer-type long-shaft pump, in accordance to one embodiment.
Figure 6:
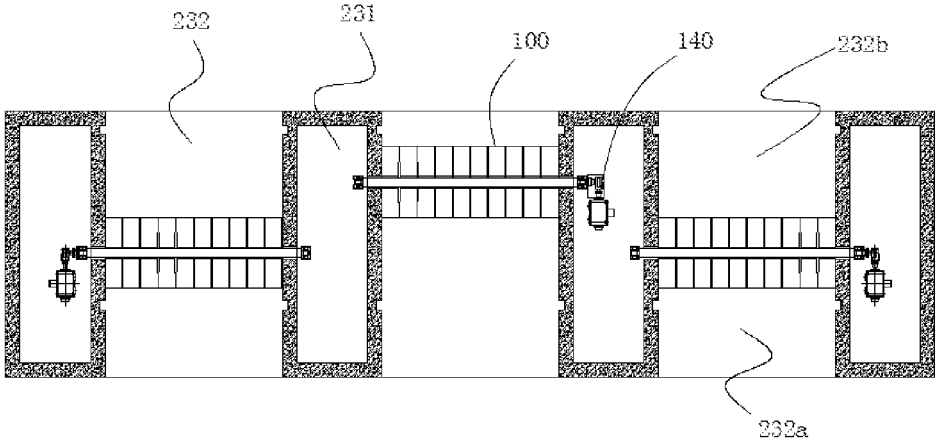
FIG. 6 is a plan sectional view of a pump station using the bailer-type long-shaft pump, in accordance to one embodiment.

As shown in FIGS. 1-3, a bailer-type long-shaft pump (100) is disclosed. The bailer-type long-shaft pump (100) comprises a plurality of bailer vehicles (110), a long shaft (120), a bearing (130); a transmission device (140), and an electric motor (150); the bearing (130) is installed on both ends of the long shaft (120); the transmission device comprises a planetary gearbox (141), an orthogonal shaft gearbox (142) and a frequency converter (143); one end of the long shaft (120) successively passes through the bearing (130), the planetary gearbox (141), the orthogonal shaft gearbox (142) and the frequency converter (143), so as to be in transmission connection with a drive shaft of the electric motor (150); the bailer vehicle (110) is provided with a cylindrical base (112) that encases and affixes to the long shaft (120), and at least three blades (111); the blades (111) are distributed on the surface of the cylindrical base (112) in an annular array radially extending from the center of the long shaft (120); the blades (111) have flat surfaces as shown in FIG. 2, or curved surfaces as shown in FIG. 3; two adjacent blades (111) and the surface of the cylindrical base (112) enclose a space to form a bailing bucket capable of bailing water from a lower water level of a water channel to a higher water level of the water channel; in some embodiments, there are a plurality of bailer vehicles (110), the plurality of bailer vehicles (110) are sequentially affixed to the long shaft (120) in tandem via the cylindrical base (112); in some embodiments, each of the plurality of the bailer vehicles (110) has equal numbers of blades; in some embodiments, the blades from any two neighboring bailer vehicles (110) are staggered so that the two neighboring bailer vehicles forms an angle and do not reside on the same plane.

As shown in FIGS. 4-6A, a pump station (200) using the bailer-type long-shaft pump (100) is disclosed. The pump station (200) comprises a pump station foundation (210), which in turn comprises a drainage section (240), a pumping section (230) and a diversion section (220) sequentially installed along the flow direction of the water channel; the pumping section (230) is provided with a plurality of equipment rooms (231) distributed traversely across the water channel at an equal distance; the equipment rooms (231) are constructed on top of the pump station foundation (210); the equipment rooms (231) divide the pumping section (230) into a plurality of pumping areas (232); a pedestrian bridge (233) is provided to connect two adjacent equipment rooms (231); one end of the pumping area (232) is a water supply end (232*a*), the other end of the pumping area (232) is a water outlet end (232*b*), and the water supply end (232*a*) and the water outlet end (232*b*) are divided with a partition; the pumping areas (232) is provided with the bailer-type long-shaft pump (100); the long shaft (120) of the bailer-type long-shaft pump (100) and the bailer vehicle (110) of the bailer-type long-shaft pump (100) are located in the water supply end (232*a*); the two ends of the long shaft (120) are rotatably installed or supported on the sidewalls between two adjacent equipment rooms (231); one end of the long shaft (120) is connected to the electric motor (150) through the transmission device (140) in the equipment room (231); the bailer-type long-shaft pumps (100) are arrayed traversing the water channel either in a straight line or is parallel but staggered; a recessed area (234) is provided at part of the pump station foundation (210) that is direct below the bailer vehicle (110); the recessed area (234) is arc-shaped and encompasses bottom of the bailer vehicle (110); a sedimentation tank (221) is provided near the water supply end (232*a*) close to the diversion section (220), and another sedimentation tank (241) is provided near the water outlet end (232*b*) closes to drainage section (240); in some embodiments, wing walls are provided on both sides of the drainage section (240) and the diversion section (220).

The sequence of operation for the bailer-type long-shaft pump (100) and the pump station (200) disclosed in the present disclosure is as follows: the electric motor (150) is started first; after deceleration via the inverter (143), the orthogonal gear box (142), and the planetary gear box (141), the electric motor (150) drives the long shaft (120) and the long the bailer vehicles (110) to rotate; through the effects of blades (111), water that enters the diversion section (220) is lifted from the water supply end (232*a*) and placed in the water outlet end (232*b*), and flows out through the drainage section (240).

The present invention discloses a system in which the equipment rooms and the bailer-type long-shaft pump are installed at the pumping section, the transmission device and the electric motors are installed within the equipment rooms. As a result, main and auxiliary workshops and maintenance rooms are not required, and no pump room is required above the ground, which reduces space requirement, shortens the construction period of the pumping station, and reduces construction costs. The bailer-type long-shaft pump also increases ascetic appeal of the pump station. In addition, by connecting the electric motor to the transmission device comprising the planetary gearbox, the orthogonal gearbox, and the frequency converter, the disclosed design effectively reducing the starting torque and greatly increasing the reduction ratio. The disclosed design meets the needs of low speed and high torque characteristic of a bailer; meanwhile, the disclosed design also ensures the smooth operation of the pumping station and improves vibration resistance and shock resistance.

While the invention has been particularly shown and described as referenced to the embodiments thereof, those skilled in the art will understand that the foregoing and other changes in form and detail may be made therein without departing from the spirit and scope of the invention. Various changes, variation, modification and permutation of the above-mentioned concepts, without input deemed creative for those ordinary persons skilled in the art are within the protection scope of the present invention.

What is claimed is:

1. A pump station (200) using a bailer-containing long-shaft pump (100), comprising:

a plurality of bailer vehicles (110);

a long shaft (120);

a bearing (130);

a transmission device (140), further comprising a planetary gearbox (141), an orthogonal shaft gearbox (142) and a frequency converter (143);

an electric motor (150);

wherein one end of the long shaft (120) is in transmission connection with a drive shaft of the electric motor (150);

wherein the plurality of bailer vehicles (110) are provided with a cylindrical base (112) configured to encase the long shaft (120), and at least three blades (111), wherein the blades (111) are distributed on a surface of the cylindrical base (112) in an annular array radially extending from a center of the long shaft (120); wherein adjacent blades (111) and the surface of the cylindrical base (112) enclose a space to form a bailing bucket capable of bailing water from a lower water level of a water channel to a higher water level of the water channel;

wherein the plurality of bailer vehicles (110) are sequentially affixed to the long shaft (120) via the cylindrical base (112), and a pump station foundation (210) that comprises a drainage section (240), a pumping section (230) and a diversion section (220) sequentially installed along the flow direction of the water channel, wherein the pumping section (230) is provided with a plurality of equipment rooms (231) distributed traversely across the water channel, wherein the equipment rooms (231) are constructed on top of the pump station foundation (210), and divide the pumping section (230) into a plurality of pumping areas (232), wherein one end of the pumping areas (232) is a water supply end (232*a*) and another end of the pumping areas (232) is a water outlet end (232*b*), wherein the water supply end (232*a*) and the water outlet end (232*b*) are divided with a partition, wherein at least one of the pumping areas (232) is provided with the bailer-containing long-shaft pump (100), wherein the long shaft (120) of the bailer-containing long-shaft pump (100) and the bailer vehicle (110) of the bailer-containing long-shaft pump (100) are located in the water supply end (232*a*), wherein two ends of the long shaft (120) are supported on sidewalls between two adjacent equipment rooms (231), and wherein one end of the long shaft (120) is connected to the electric motor (150) through the transmission device (140) in the equipment rooms (231).

2. The pump station (200) according to claim 1, wherein a recessed area (234) is provided at part of the pump station foundation (210) that is directly below the plurality of bailer vehicles (110), wherein the recessed area (234) is arc-shaped and encompasses a bottom of the bailer vehicles (110).

3. The pump station (200) according to claim 1, wherein the plurality of the equipment rooms (231) are distributed at equal distance to each other.

4. The pump station (200) according to claim 1, wherein each of the pumping areas (232) is provided with a bailer-containing long-shaft pump (100), and the bailer-containing long-shaft pumps (100) are arrayed traversing the water channel either in a straight line or is parallel but staggered.

5. The pump station (200) according to claim 1, further comprising a pedestrian bridge that connects two adjacent equipment rooms (231).

6. The pump station (200) according to claim 1, further comprising a sedimentation tank (221) near the water supply end (232*a*) and another sedimentation tank (241) near the water outlet end (232*b*).

7. The pump station (200) according to claim 1, further comprising wing walls on both sides of the drainage section (240) and the diversion section (220).

8. The pump station (200) using the bailer-containing long-shaft pump (100) of claim 1 wherein the each of the plurality of the bailer vehicles (110) has equal numbers of blades (111).

9. The pump station (200) using the bailer-containing long-shaft pump (100) of claim 1 wherein the blades from any two neighboring bailer vehicles (110) are staggered and do not reside on the same plane.

* * * * *